US006025672A

United States Patent [19]

Machida

[11] Patent Number: 6,025,672

[45] Date of Patent: Feb. 15, 2000

[54] GAS DISCHARGE SURGE TUBE WITH SPECIFIC TRIGGER WIRES ARRANGEMENT

[75] Inventor: Kazuhiko Machida, Nagano, Japan

[73] Assignee: Shinko Electric Industries, Ltd., Nagano, Japan

[21] Appl. No.: 09/044,805

[22] Filed: Mar. 20, 1998

[30] Foreign Application Priority Data

Mar. 31, 1997 [JP] Japan ..... 9-098259
Dec. 12, 1997 [JP] Japan ..... 9-362877

[51] Int. Cl.[7] ..... H01J 17/26

[52] U.S. Cl. ..... 313/231.11; 313/631

[58] Field of Search ..... 313/231.11, 244, 313/268, 631, 325, 306, 581, 596, 620

[56] References Cited

U.S. PATENT DOCUMENTS 4,433,354 2/1984 Lange et al. ..... 313/325
4,466,043 8/1984 Munt ..... 361/120

FOREIGN PATENT DOCUMENTS 57-176679 10/1982 Japan .
59-98488 6/1984 Japan .
7-29667 1/1995 Japan .
1 228 396 4/1971 United Kingdom .

OTHER PUBLICATIONS

Japan Abstract No. 0683248 published Oct. 7, 1994 for Lightning Arrester by inventor Machida Kazuhiko.

*Primary Examiner*—Vip Patel

*Attorney, Agent, or Firm*—Pennie & Edmonds LLP

[57] ABSTRACT

It is an object of the invention to provide a discharge tube in which the electrical insulating property between the discharge trigger wires is not deteriorated by the sputtering substance generated when discharge is conducted between the upper and the lower discharge electrode. There are provided sub-discharge trigger wires 50 at the center of the inner circumferential wall of the airtight cylinder 10 under the condition that the sub-discharge trigger wires 50 are electrically insulated from the upper and the lower discharge electrode. At the same time, there are provided discharge trigger wires 30*a* connected with the upper discharge electrode and discharge trigger wires 30*b* connected with the lower discharge electrode in the upper and the lower portion of the inner circumferential wall of the airtight cylinder 10 at which there is no possibility of adhesion of the sputtering substance 40 generated in the process of discharging conducted by the upper and the lower discharge electrode. A distance between the discharge trigger wires 30*a*, 30*b* is electrically reduced via the sub-discharge trigger wires 50. An initial discharge is stably generated at an early stage between the fore end portions of the discharge trigger wires 30*a*, 30*b* and the end portions of the sub-discharge trigger wires 50 located close to the discharge trigger wires 30*a*, 30*b*.

10 Claims, 7 Drawing Sheets

GAS DISCHARGE SURGE TUBE WITH SPECIFIC TRIGGER WIRES ARRANGEMENT

BACKGROUND OF THE INVENTION

1. Field of the Invention

The present invention relates to a discharge tube in which a pair of upper and lower discharge electrodes are vertically arranged, in an airtight cylinder made of insulating material, and are vertically opposed to each other in the axial direction.

2. Description of the Related Art

As shown in FIG. 14, there is provided a discharge tube used for a "Switching Spark Gap (SSG)" for lighting a metal halide lamp and also used as an arrester for preventing generation of a surge voltage.

In this discharge tube, there are provided an upper discharge electrode 20*a* and a lower discharge electrode 20*b*, the profiles of which are cylindrical, which are made of a metal such as 42-alloy (iron-nickel alloy) and are arranged in an axial direction in an airtight cylinder 10 made of an insulating material such as a ceramic, and these upper discharge electrode 20*a* and lower discharge electrode 20*b* are arranged vertically opposed to each other. Between the fore end surfaces of the upper discharge electrode 20*a* and lower discharge electrode 20*b*, there is formed a discharge gap of a predetermined width for generating an electric discharge.

The upper and lower opening ends of the airtight cylinder 10 are airtightly closed by covers 22*a*, 22*b* made of a metal such as 42-alloy which are attached to the upper discharge electrode 20*a* and the lower discharge electrode 20*b*. The covers 22*a*, 22*b* are airtightly joined, by means of soldering, onto metalized layers 12*a*, 12*b* which are formed on the upper and lower opening end surfaces of the airtight cylinder 10.

On the inner circumferential wall of the airtight cylinder 10, there are provided a plurality of narrow band-shaped discharge trigger wires 30*a*, 30*b*, made of carbon, which are arranged at regular intervals in the lateral direction in parallel with the axis of the airtight cylinder 10.

In the specific structure of the discharge tube, shown in the development view of FIG. 15, a plurality of discharge trigger wires 30*a* are electrically connected to the upper discharge electrode 20*a* via the metalized layer 12*a* in the upper portion of the inner circumferential wall of the airtight cylinder 10. The plurality of discharge trigger wires 30*a* are arranged in the lateral direction, and the lower end portions of the discharge trigger wires 30*a* cross the center of the inner circumferential wall of the airtight cylinder 10. A plurality of discharge trigger wires 30*b* are electrically connected to the lower discharge electrode 20*b* via the metalized layer 12*b* in the lower portion of the inner circumferential wall of the airtight cylinder 10. The plurality of discharge trigger wires 30*b* are arranged in the lateral direction, and upper end portions of the discharge trigger wires 30*b* cross the center of the inner circumferential wall of the airtight cylinder 10. The plurality of discharge trigger wires 30*a*, 30*b* are alternately arranged in the lateral direction on the inner circumferential wall of the airtight cylinder 10.

The discharge tube shown in FIGS. 14 and 15 is composed as described above. In this discharge tube, when a voltage higher than a predetermined value is impressed between the covers 22*a*, 22*b* attached to the upper discharge electrode 20*a* and the lower discharge electrode 20*b*, it is possible to generate an electrical discharge between the fore end surfaces of the upper discharge electrode 20*a* and the lower discharge electrode 20*b*.

At this time, it is possible to generate an initial discharge at an early stage between the end portions of the discharge trigger wires 30*a*, 30*b* formed on the inner circumferential wall of the airtight cylinder 10. Due to the initial discharge generated between the end portions of the discharge trigger wires 30*a*, 30*b*, it is possible to induce a discharge between the fore end surfaces of the upper discharge electrode 20*a* and the lower discharge electrode 20*b* in quick response.

However, the following problems were caused in the above discharge tube. When an electrical discharge was generated between the fore end surfaces of the upper discharge electrode 20*a* and the lower discharge electrode 20*b*, a portion of metal composing the upper discharge electrode 20*a* and the lower discharge electrode 20*b* was changed into powder and scattered into the surroundings. A sputtering substance 40 was made to adhere to the center of the inner circumferential wall of the airtight cylinder 10 in the lateral direction as shown in FIG. 15. Due to the sputtering substance 40, the electrical insulating property between the discharge trigger wires 30*a*, 30*b*, which were arranged on the inner circumferential wall of the airtight cylinder 10, was deteriorated. As a result, it was impossible to precisely generate an initial discharge between the end portions of the discharge trigger wires 30*a*, 30*b* over a long period of time.

In order to prevent the deterioration of electrical insulation between the discharge trigger wires 30*a*, 30*b*, it is possible to arrange the discharge trigger wires 30*a* in such a manner that the discharge trigger wires 30*a* are electrically connected with the upper discharge electrode 20*a* while they are made to be short and made to come close to the upper end of the inner circumferential wall of the airtight cylinder 10 and that the discharge trigger wires 30*b* are electrically connected with the lower discharge electrode 20*b* while they are made to be short and made to come close to the lower end of the inner circumferential wall of the airtight cylinder 10.

According to the above method, it becomes possible to arrange the discharge trigger wires 30*a*, 30*b* at positions close to the upper and the lower end of the inner circumferential wall of the airtight cylinder 10 which are distant from the center of the inner circumferential wall of the airtight cylinder 10 to which the sputtering substance 40 scattered from the upper discharge electrode 20*a* and the lower discharge electrode 20*b* is made to adhere. Accordingly, it is possible to prevent the deterioration of electrical insulation between the discharge trigger wires 30*a*, 30*b* which is caused by the sputtering substance 40 adhering to the center of the inner circumferential wall of the airtight cylinder 10 in the lateral direction, wherein the adhering portion, to which the sputtering substance 40 adheres, at the center of the inner circumferential wall of the airtight cylinder is formed into a band-shape.

However, the above arrangement was disadvantageous in that a distance between the discharge trigger wires 30*a*, 30*b* was extended. Therefore, it was impossible to generate an initial discharge at an early stage between the discharge trigger wires 30*a*, 30*b* in a stable condition.

SUMMARY OF THE INVENTION

The present invention has been accomplished to solve the above problems. It is an object of the present invention to provide a discharge tube capable of generating an electrical discharge between the fore end surfaces of the upper and the lower discharge electrode in quick response, and the electrical insulating property between the discharge trigger wires is not deteriorated.

In order to attain the above object, the present invention is to provide a discharge tube in which an upper discharge electrode and lower discharge electrode are arranged in an airtight cylinder made of insulating material, being vertically opposed to each other in the axial direction of the airtight cylinder, an upper end opening and lower end opening of the airtight cylinder are airtightly closed by covers attached to the upper discharge electrode and the lower discharge electrode, and discharge trigger wires are arranged on an inner circumferential wall of the airtight cylinder, the discharge tube comprising: sub-discharge trigger wires arranged at the center of the inner circumferential wall of the airtight cylinder, the sub-discharge trigger wires being electrically insulated from the upper discharge electrode and the lower one; discharge trigger wires electrically connected with the upper discharge electrode, the discharge trigger wires being arranged in an upper portion of the inner circumferential wall of the airtight cylinder; and the discharge trigger wires electrically connected with the lower discharge electrode, the discharge trigger wires being arranged in a lower portion of the inner circumferential wall of the airtight cylinder, wherein the distances from the respective discharge trigger wires to the sub-discharge trigger wires arranged close to the discharge trigger wires are made equal.

In this discharge tube, the discharge trigger wires electrically connected to the upper discharge electrode and the discharge trigger wires electrically connected to the lower discharge electrode are arranged in the upper and the lower portion of the inner circumferential wall of the airtight cylinder to which the sputtering substance generated by the upper and the lower discharge electrode in the process of discharge hardly adheres.

Due to the foregoing, the electrical insulating property between the discharge trigger wires arranged in the upper and the lower portion of the inner circumferential wall of the airtight cylinder is hardly affected or is not affected by the belt-shaped sputtering substance which is generated and made to adhere to the center of the inner circumferential wall of the airtight cylinder in the lateral direction when electrical discharge is conducted by the upper and the lower discharge electrode.

Since the sub-discharge trigger wires are arranged at the center of the inner circumferential wall of the airtight cylinder, the distance between the end portions of the discharge trigger wires arranged between the upper and the lower portion of the inner circumferential wall of the airtight cylinder is electrically reduced via the sub-discharge trigger wires. An initial discharge is generated and stabilized at an early stage between the end portions of the sub-discharge triggers and the discharge triggers located close to them. Being facilitated by the initial discharge, a discharge is positively induced in quick response between the fore end surfaces of the upper and the lower discharge electrode.

Since the distances between the discharge trigger wires and the sub-discharge trigger wires located close to them are made equal, initial discharges can be simultaneously and equally generated between the discharge trigger wires and the sub-discharge trigger wires located close to them. Due to the foregoing, it is possible to prevent the occurrence of a problem in which portions of the discharge and sub-discharge trigger wires are damaged at an early stage when the initial discharges are generated only between them.

The discharge trigger wires extend from the upper or the lower portion on the inner circumferential wall of the airtight cylinder toward the center of the airtight cylinder, and the end surfaces of the sub-discharge trigger wires and the discharge trigger wires, which generate the initial discharge, are located close to the end surfaces of the upper and the lower discharge electrode generating the discharge. Therefore, compared with a discharge tube in which the initial discharge is generated between the end portions of the discharge trigger wires located in the upper and the lower portion of the airtight cylinder which are distant from the fore end surfaces of the upper and the lower electrode, the discharge can be positively generated in quick response between the fore end surfaces of the upper and the lower discharge electrode by the initial discharge generated between the end surfaces of the sub-discharge trigger wires and the discharge trigger wires.

Since the initial discharge is generated between the end portions of the linear discharge trigger wires and the linear sub-discharge trigger wires, electrons for a creeping corona discharge used for inducing an initial discharge can effectively converge upon the end portions of the discharge trigger wires and the sub-discharge trigger wires. The initial discharge can be quickly and stably generated between the end surfaces of the discharge trigger wires and the sub-discharge trigger wires.

The discharge tube of the present invention is preferably composed as follows. Sub-discharge trigger wires are arranged at the center of the inner circumferential wall of the airtight cylinder so that the end portions of the sub-discharge trigger wires can overlap with the fore end portions of the discharge trigger wires when a view is laterally taken in a direction perpendicular to the axis of the airtight cylinder.

In this discharge tube, it is possible to generate the initial discharge in a wide range between the end portion side edges of the sub-discharge trigger wires and the fore end side edges of the discharge trigger wires, which overlap with each other at a predetermined distance when a view is laterally taken in a direction perpendicular to the axis of the airtight cylinder. Compared with a case in which the initial discharge is generated between the narrow fore end edges of the sub-discharge trigger wires and the narrow fore end edges of the discharge trigger wires, it is possible to generate the initial discharge stably between the sub-discharge trigger wires and the discharge trigger wires. At the same time, it is possible to prevent the narrow fore end edges of the sub-discharge trigger wires and the narrow fore end edges of the discharge trigger wires from being damaged at an early stage by the initial discharge.

The discharge tube of the present invention is preferably composed as follows. A plurality of sub-discharge trigger wires are arranged on the inner circumferential wall of the airtight cylinder at regular intervals, and discharge trigger wires are regularly arranged in a portion on the inner circumferential wall of the airtight cylinder between the respective sub-discharge trigger wires.

Alternatively, the discharge trigger wires and/or the sub-discharge trigger wires are arranged in parallel with the axis of the airtight cylinder.

Alternatively, the discharge trigger wires and/or the sub-discharge trigger wires are arranged oblique to the axis of the airtight cylinder.

In this discharge tube, when a plurality of sub-discharge trigger wires and a plurality of discharge trigger wires, which are used for generating the initial discharge, are regularly arranged on the inner circumferential wall of the airtight positioned they can be positioned in a direction parallel with the axis of the airtight cylinder or in a direction oblique to the axis of the airtight cylinder.

The discharge tube of the present invention is preferably composed as follows. The profiles and sizes of the discharge trigger wires are the same, and the profiles and sizes of the sub-discharge trigger wires are the same.

This discharge tube is composed in such a manner that profiles and sizes of the discharge trigger wires are the same, and profiles and sizes of the sub-discharge trigger wires are the same. Accordingly, it is possible to prevent a portion of the discharge and the sub-discharge trigger wires from being damaged by the initial discharge generated between the discharge trigger wires and the sub-discharge trigger wires earlier than between other discharge and sub-discharge trigger wires.

The discharge tube of the present invention is preferably composed as follows. The discharge trigger wires electrically connected to the upper discharge electrode and the discharge trigger wires electrically connected to the lower discharge electrode are alternately arranged on the inner circumferential wall of the airtight cylinder.

Alternatively, the discharge trigger wires electrically connected to the upper discharge electrode and the discharge trigger wires electrically connected to the lower discharge electrode are arranged on the inner circumferential wall of the airtight cylinder being opposed to each other.

In this discharge tube, the discharge trigger wires electrically connected with the upper discharge electrode and/or the discharge trigger wires electrically connected with the lower electrode can be arranged in a portion on the inner circumferential wall of the airtight cylinder positioned between the sub-discharge trigger wires, and the initial discharge can be generated between the end portions of the discharge trigger wires and the sub-discharge trigger wires located close to them.

The discharge tube of the present invention is preferably composed as follows. The following relational expression is satisfied, $$B/2 \leqq H \leqq (A-B)/2$$

where A is a height of the airtight cylinder, B is a discharge gap between the fore end surfaces of the upper and the lower discharge electrode, and H is a distance between an upper end of the sub-discharge trigger wire and an upper end edge of the airtight cylinder opposed to the upper end of the sub-discharge trigger wire and H is also a distance between a lower end of the sub-discharge trigger wire and a lower end edge of the airtight cylinder opposed to the lower end of the sub-discharge trigger wire.

In this discharge tube, the discharge starting voltage generated between the upper and the lower discharge electrode the first time can be made substantially equal to the discharge starting voltage generated between the same upper and the lower discharge electrode the next time and after.

The discharge tube of the present invention is preferably composed as follows. The lower end portions of the discharge trigger wires arranged in the upper portion of the inner circumferential wall of the airtight cylinder are located at the same positions as the position of the fore end face of the upper discharge electrode or at positions higher than the position of the fore end face of the upper discharge electrode when a view is laterally taken in a direction perpendicular to the axis of the airtight cylinder, and upper end portions of the discharge trigger wires arranged in the lower portion of the inner circumferential wall of the airtight cylinder are located at the same positions as the position of the fore end surface of the lower discharge electrode or alternatively at the positions lower than the position of the fore end surface of the lower discharge electrode when a view is laterally taken in a direction perpendicular to the axis of the airtight cylinder.

In this discharge tube, it is possible to arrange the discharge trigger wires in the upper and the lower portion of the inner circumferential wall of the airtight cylinder while not arranging them at the center of the inner circumferential wall of the airtight cylinder to which the sputtering substance adheres, wherein the sputtering substance is composed of metallic powder generated in the process of a discharge from the fore end surfaces of the upper and the lower electrode on which coating for the formation of the discharge surface is coated. Accordingly, it is possible to prevent the deterioration of electrical insulation, which is caused by the sputtering substance, between the discharge trigger wires arranged in the upper and the lower portion of the inner circumferential wall of the airtight cylinder.

BRIEF DESCRIPTION OF THE DRAWINGS

These and other objects of the present invention will become apparent from the following detailed description of the preferred embodiment of the invention, taken in connection with the accompanying drawings.

In the drawings.

DESCRIPTION OF THE PREFERRED EMBODIMENTS

Figure 1:
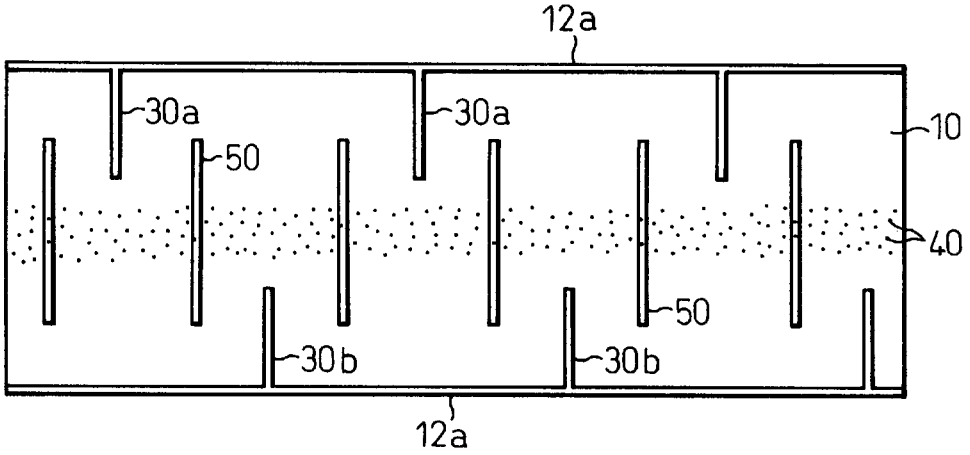
FIG. 1 is a development view of the inner circumferential wall of the airtight cylinder of the discharge tube of the present invention.

Referring to the accompanying drawings, embodiments of the present invention will be explained below.

The preferred embodiments of the discharge tube of the present invention are shown in FIGS. 1 to 7. FIGS. 1 to 7 are development views of the inner circumferential wall of the airtight cylinder. Embodiments of the discharge tube will be explained as follows.

In the discharge tube shown in the drawings, a plurality of narrow belt-shaped sub-discharge trigger wires 50 made of carbon are arranged at the center of the inner circumferential wall of the airtight cylinder 10 in the lateral direction at regular intervals.

Figure 2:
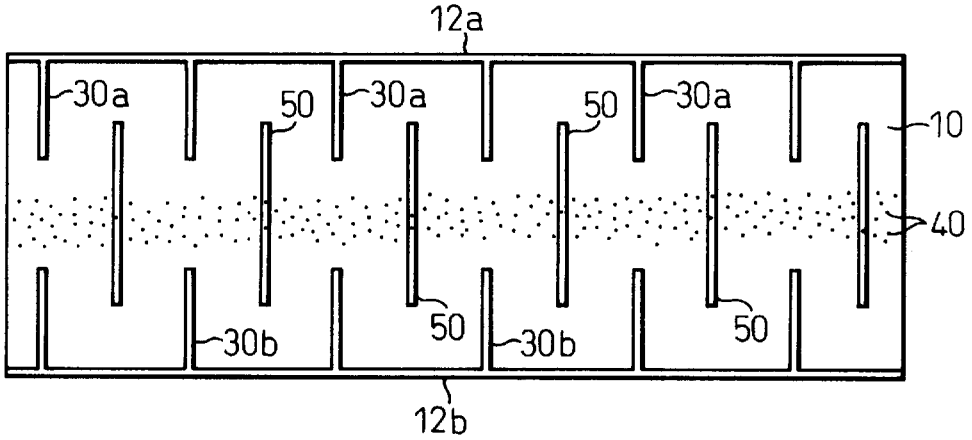
FIG. 2 is a development view of the inner circumferential wall of the airtight cylinder of the discharge tube of the present invention.
Figure 7:
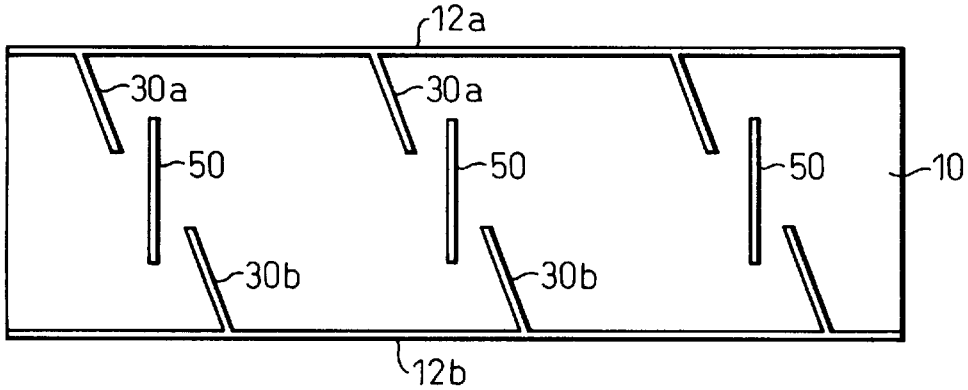
FIG. 7 is a development view of the inner circumferential wall of the airtight cylinder of the discharge tube of the present invention.

In the discharge tubes shown in FIGS. 1, 2 and 7, a plurality of sub-discharge trigger wires 50 are arranged in parallel with the axis of the airtight cylinder 10.

In the discharge tubes shown in FIGS. 3, 4, 5 and 6, a plurality of sub-discharge trigger wires 50 are arranged oblique to the axis of the airtight cylinder 10.

In the upper portion of the inner circumferential wall of the airtight cylinder 10 to which the sputtering substance 40 generated from the upper discharge electrode 20*a* and the lower discharge electrode 20*b* in the process of discharge hardly adheres or does not adhere, there are provided a plurality of narrow belt-shaped trigger wires 30*a* in the lateral direction which continue to the metalized layer 12*a* formed on the opening end surface at the upper end of the airtight cylinder 10. In the lower portion of the inner circumferential wall of the airtight cylinder 10 to which the sputtering substance 40 generated from the upper discharge electrode 20*a* and the lower discharge electrode 20*b* in the process of discharge hardly adheres or does not adhere, there are provided a plurality of narrow belt-shaped trigger wires 30*b* in the lateral direction which continue to the metalized layer 12*b* formed on the opening end surface at the lower end of the airtight cylinder 10. A plurality of discharge trigger wires 30*a*, 30*b* and a plurality of sub-discharge trigger wires 50 are regularly arranged so that the distances between the discharge trigger wires 30*a*, 30*b* and the sub-discharge trigger wires 50 located close to them are equal.

Specifically, in the discharge tube shown in FIG. 1, the discharge trigger wires 30*a*, 30*b* are alternately arranged in the lateral direction on the inner circumferential wall of the airtight cylinder 10. The discharge trigger wires 30*a*, 30*b* are arranged in the middle portions of the inner circumferential wall of the airtight cylinder 10 located between the sub-discharge trigger wires 50.

In the discharge tube shown in FIG. 2, the discharge trigger wires 30*a*, 30*b* are arranged in the lateral direction being vertically opposed to each other on the inner circumferential wall of the airtight cylinder 10. The discharge trigger wires 30*a*, 30*b* are arranged in the middle portions of the inner circumferential wall of the airtight cylinder 10 located between the sub-discharge trigger wires 50.

Figure 3:
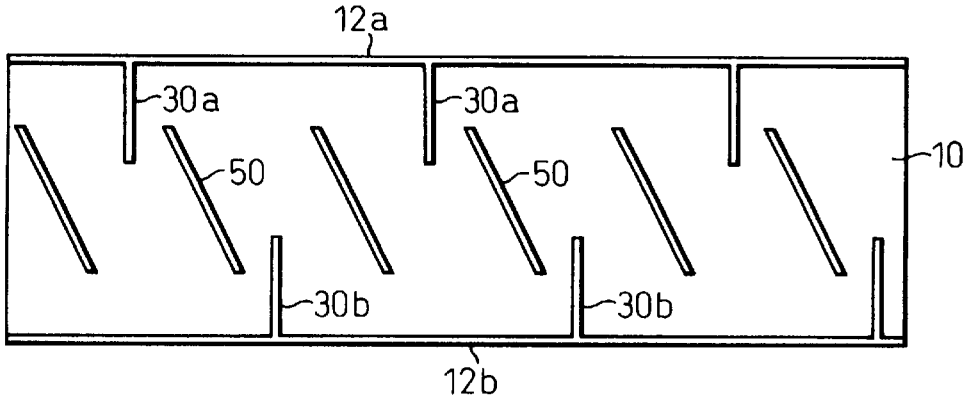
FIG. 3 is a development view of the inner circumferential wall of the airtight cylinder of the discharge tube of the present invention.

In the discharge tube shown in FIG. 3, the discharge trigger wires 30*a*, 30*b* are alternately arranged in the lateral direction on the inner circumferential wall of the airtight cylinder 10. The discharge trigger wires 30*a*, 30*b* are arranged at portions of the inner circumferential wall of the airtight cylinder 10 located close to the end portions of the sub-discharge trigger wires 50.

Figure 4:
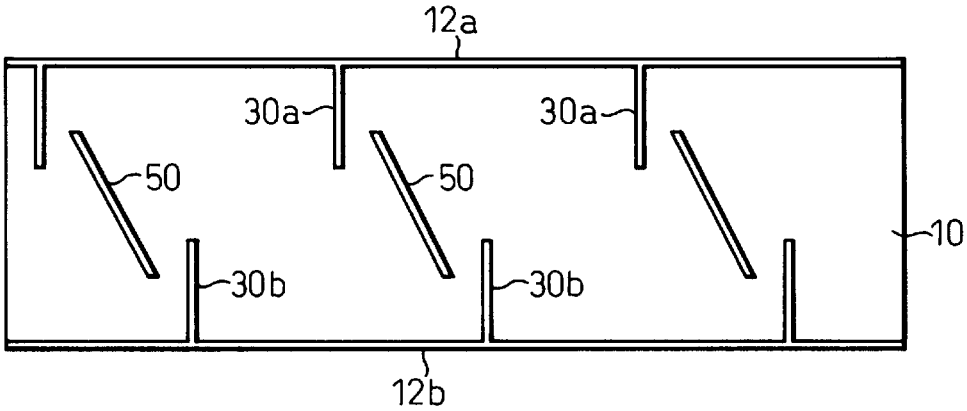
FIG. 4 is a development view of the inner circumferential wall of the airtight cylinder of the discharge tube of the present invention.

In the discharge tube shown in FIG. 4, the discharge trigger wires 30*a*, 30*b* are alternately arranged in the lateral direction on the inner circumferential wall of the airtight cylinder 10. The discharge trigger wires 30*a*, 30*b* are arranged at portions of the inner circumferential wall of the airtight cylinder 10 located close to the end portions of the sub-discharge trigger wires 50.

Figure 5:
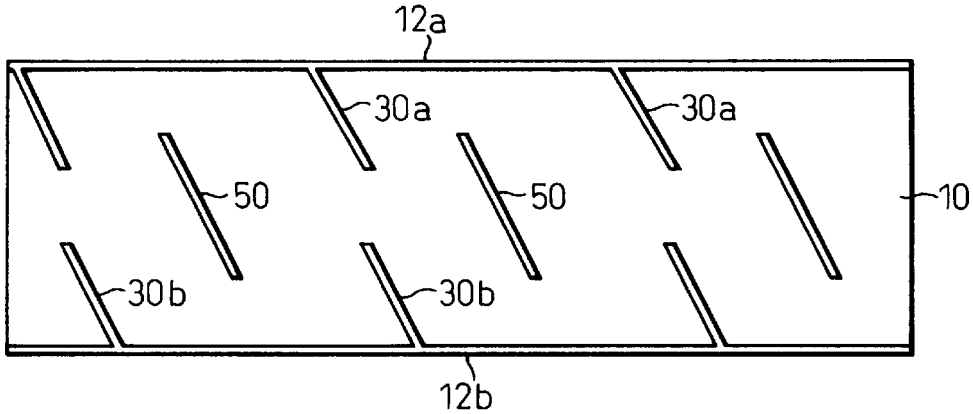
FIG. 5 is a development view of the inner circumferential wall of the airtight cylinder of the discharge tube of the present invention.

In the discharge tube shown in FIG. 5, the discharge trigger wires 30*a*, 30*b* are arranged in the lateral direction being substantially obliquely opposed to each other in the vertical direction on the inner circumferential wall of the airtight cylinder 10. The discharge trigger wires 30*a*, 30*b* are arranged in the middle portions of the inner circumferential wall of the airtight cylinder 10 located between the sub-discharge trigger wires 50.

Figure 6:
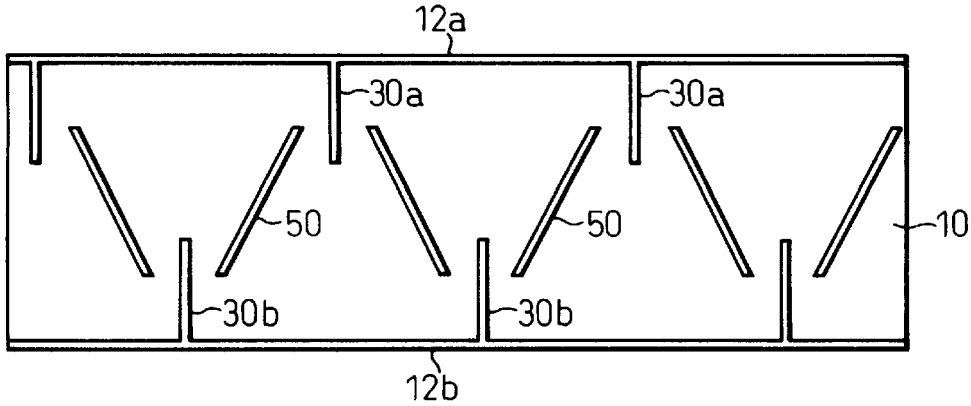
FIG. 6 is a development view of the inner circumferential wall of the airtight cylinder of the discharge tube of the present invention.

In the discharge tube shown in FIG. 6, the discharge trigger wires 30*a*, 30*b* are alternately arranged in the lateral direction on the inner circumferential wall of the airtight cylinder 10. The discharge trigger wires 30*a*, 30*b* are arranged at portions of the inner circumferential wall of the airtight cylinder 10 located close to the end portions of the sub-discharge trigger wires 50.

In the discharge tube shown in FIG. 7, the discharge trigger wires 30*a*, 30*b* are arranged in the lateral direction being substantially opposed to each other in the vertical direction on the inner circumferential wall of the airtight cylinder 10. The discharge trigger wires 30*a*, 30*b* are arranged at portions of the inner circumferential wall of the airtight cylinder 10 located close to the end portions of the sub-discharge trigger wires 50.

In addition to that, in the discharge tubes shown in FIGS. 1 to 7, the sub-trigger wires 50 are extended in the vertical direction or in the oblique direction of the center of the inner circumferential wall of the airtight cylinder 10 so that the end portions of the sub-discharge trigger wires 50 can overlap with the fore end portions of the discharge trigger wires 30*a*, 30*b* when a view is laterally taken in a direction perpendicular to the axis of the airtight cylinder 10.

The widths and lengths of the discharge trigger wires 30*a*, 30*b* are the same, and widths and lengths of the sub-discharge trigger wires 50 are the same. In other words, the profiles and sizes of the discharge trigger wires 30*a*, 30*b* are the same, and the profiles and sizes of the sub-discharge trigger wires 50 are the same.

Figure 14:
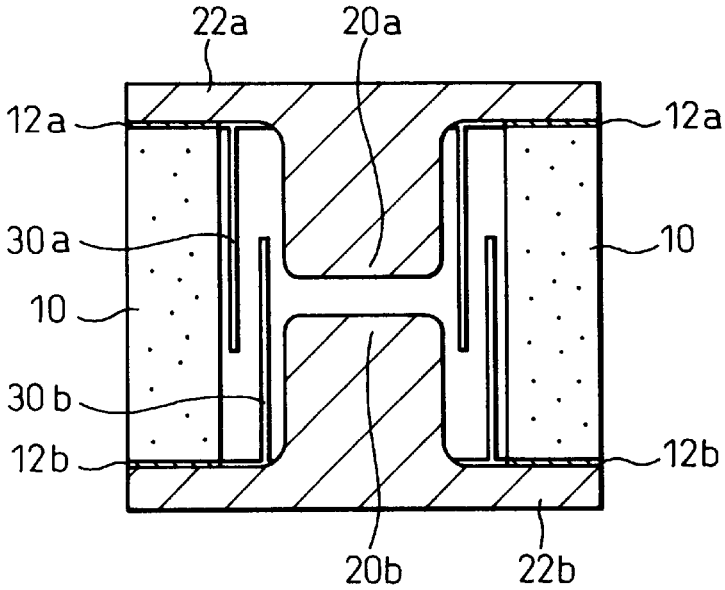
Fig. 14 PRIOR ART
FIG. 14 is a front cross-sectional view of the discharge tube of the prior art.
Figure 15:
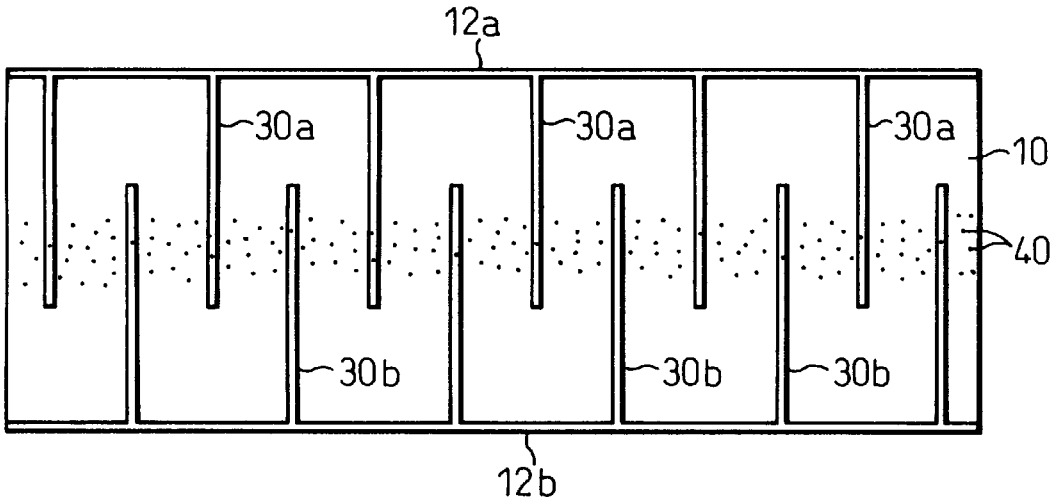
Fig. 15 PRIOR ART
FIG. 15 is a development view of the inner circumferential wall of the airtight cylinder of the discharge tube of the prior art.
Figure 16:
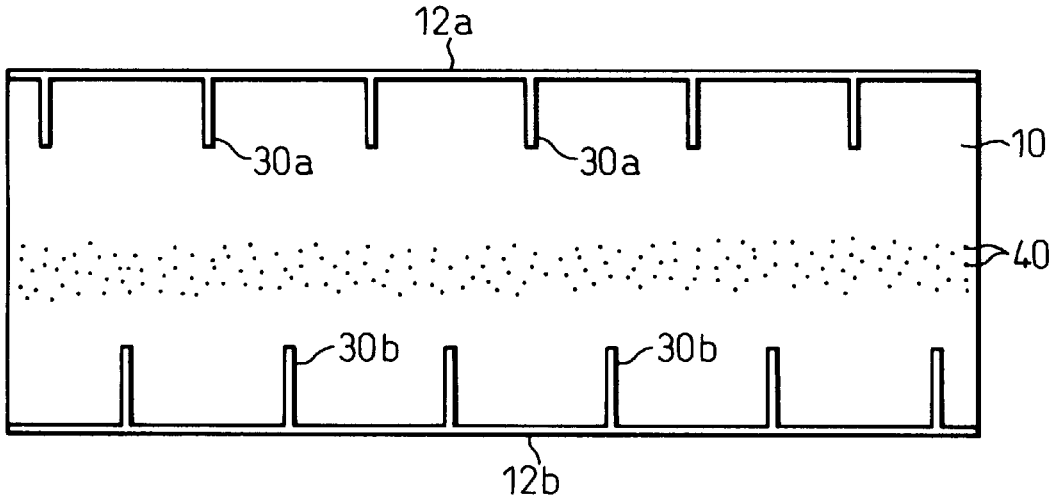
Fig. 16 PRIOR ART
FIG. 16 is a development view of the inner circumferential wall of the airtight cylinder of the discharge tube of the prior art.

Other points of the structure are the same as those of the discharge tube shown in FIGS. 14 and 15. In this discharge tube, the electrical insulating property between the discharge trigger wires 30*a*, 30*b* arranged in the upper and the lower portion of the inner circumferential wall of the airtight cylinder 10 is hardly affected or is not affected by the sputtering substance which adheres to the center of the inner circumferential wall of the airtight cylinder 10 when electrical discharge is generated by the upper discharge electrode 20*a* and the lower discharge electrode 20*b*.

The distance between the end portions of the discharge trigger wires 30*a*, 30*b* arranged at the upper and the lower portion of the inner circumferential wall of the airtight cylinder 10 is electrically reduced via the sub-discharge trigger wires 50. An initial discharge is generated and stabilized at an early stage between the end portions of the sub-discharge triggers 50 and the discharge triggers 30*a*, 30*b* located close to them. Being facilitated by the initial discharge, a discharge is positively induced between the fore end surfaces of the upper discharge electrode 20*a* and the lower discharge electrode 20*b* in quick response.

The end surfaces of the sub-discharge trigger wires 50 and the discharge trigger wires 30*a*, 30*b*, which generate the initial discharge, are located close to the end surfaces of the upper discharge electrode 20*a* and the lower discharge electrode 20*b* by which the discharge is generated. Therefore, the discharge can be positively induced in quick response between the fore end surfaces of the upper discharge electrode 20*a* and the lower discharge electrode 20*b* by the initial discharge induced between the end surfaces of the sub-discharge trigger wires 50 and the discharge trigger wires 30*a*, 30*b*.

Since the initial discharge is generated between the end portions of the narrow band-shaped discharge trigger wires 30*a*, 30*b* and the narrow band-shaped sub-discharge trigger wires 50 located close to them, electrons for a creeping corona discharge used for generating the initial discharge can effectively converge upon the end portions of the discharge trigger wires 30*a*, 30*b* and the sub-discharge trigger wires 50. The initial discharge can be quickly and stably generated between the end surfaces of the discharge trigger wires 30*a*, 30*b* and the sub-discharge trigger wires 50.

The plurality of discharge trigger wires 30*a*, 30*b* and sub-discharge trigger wires 50 are arranged so that the distances between the respective discharge trigger wires 30*a*, 30*b* and the sub-discharge trigger wires 50 located close to them can be the same. Due to the above arrangement, the initial discharges can be simultaneously generated between the end portions of the discharge trigger wires 30*a*, 30*b* and the sub-discharge trigger wires 50 located close to them. The initial discharges are generated only between the end surfaces of a portion of discharge trigger wires 30*a*, 30*b* arranged on the inner circumferential wall of the airtight cylinder 10 and the sub-discharge trigger wires 50, and it is possible to prevent the portion of the discharge trigger wires 30*a*, 30*b* and sub-discharge trigger wires 50 being damaged earlier than other discharge trigger wires 30*a*, 30*b* and sub-discharge trigger wires 50.

It is possible to stably generate the initial discharge in a wide range between the end portion side edges of the sub-discharge trigger wires 50 and the fore end side edges of the discharge trigger wires 30*a*, 30*b*, which overlap with each other by a predetermined distance when a view is laterally taken in a direction perpendicular to the axis of the airtight cylinder 10. Also, it is possible to prevent the narrow fore end edges of the sub-discharge trigger wires 50 and the narrow fore end edges of the discharge trigger wires 30*a*, 30*b* from being damaged at an early stage by the initial discharge.

Profiles and sizes of the discharge trigger wires 30*a*, 30*b* are the same, and profiles and sizes of the sub-discharge trigger wires 50 are the same. Therefore, by the initial discharges generated between the end portions of the discharge trigger wires 30*a*, 30*b* and the sub-discharge trigger wires 50, it is possible to prevent a portion of discharge trigger wires 30*a*, 30*b* and sub-discharge trigger wires 50 from being damaged earlier than other discharge trigger wires 30*a*, 30*b* and sub-discharge trigger wires 50. Therefore, deterioration of the life of the discharge tube can be prevented.

Figure 8:
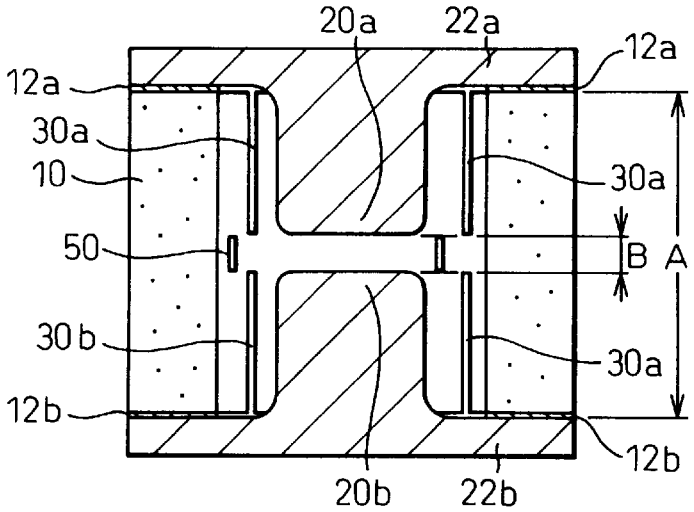
FIG. 8 is a front cross-sectional view of the discharge tube of the present invention.
Figure 9:
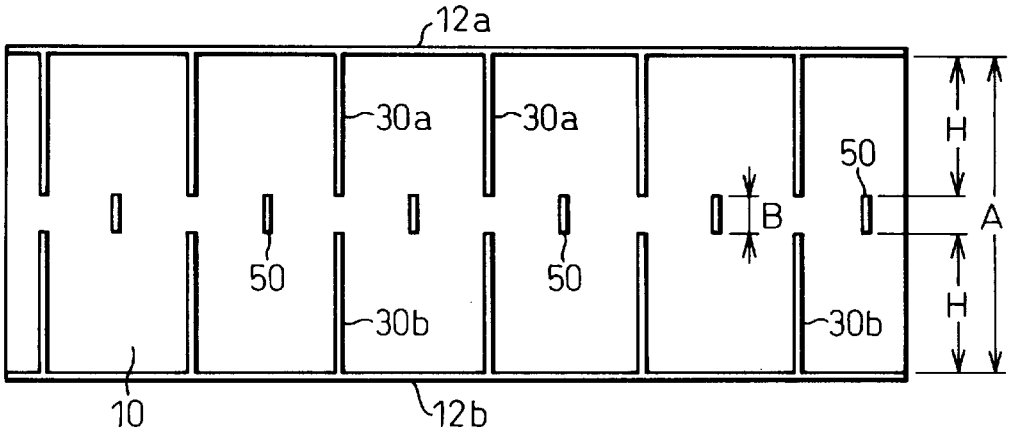
FIG. 9 is a development view of the inner circumferential wall of the airtight cylinder of the discharge tube of the present invention.

FIGS. 8 and 9 are views showing another preferable embodiment of the discharge tube of the present invention. FIG. 8 is a front cross-sectional view of the discharge tube, and FIG. 9 is a development view of the inner circumferential wall of the airtight cylinder. This discharge tube will be explained below.

In the discharge tube shown in the drawings, the following relational expression is satisfied, $$B/2 \leqq H \leqq (A-B)/2$$

where A is a height of the airtight cylinder 10, B is a discharge gap between the fore end surfaces of the upper discharge electrode 20*a* and the lower discharge electrode 20*b*, and H is a distance between the upper end of the sub-discharge trigger wire 50 and the upper end edge of the airtight cylinder 10 opposed to the upper end of the sub-discharge trigger wire and H is also a distance between the lower end of the sub-discharge trigger wire 50 and the lower end edge of the airtight cylinder 10 opposed to the lower end of the sub-discharge trigger wire. The above relational expression was introduced by the inventors as a result of the experiments made a large number of times in which discharge tubes of various profiles were used.

Other points of the structure of the above discharge tube are the same as those of any discharge tube shown in FIGS. 1 to 7. In this discharge tube, as the experimental data shows in FIG. 10, the initial discharge starting voltage V0 generated between the fore end surfaces of the upper discharge electrode 20*a* and the lower discharge electrode 20*b* can be made to be substantially the same as the next time discharge starting voltages V1, V2, V3 . . . generated between the same fore end surfaces of the upper discharge electrode 20*a* and the lower discharge electrode 20*b*. Therefore, it is possible to extend the life of a metal halide lamp which is lit by the discharge tube.

Figure 10:
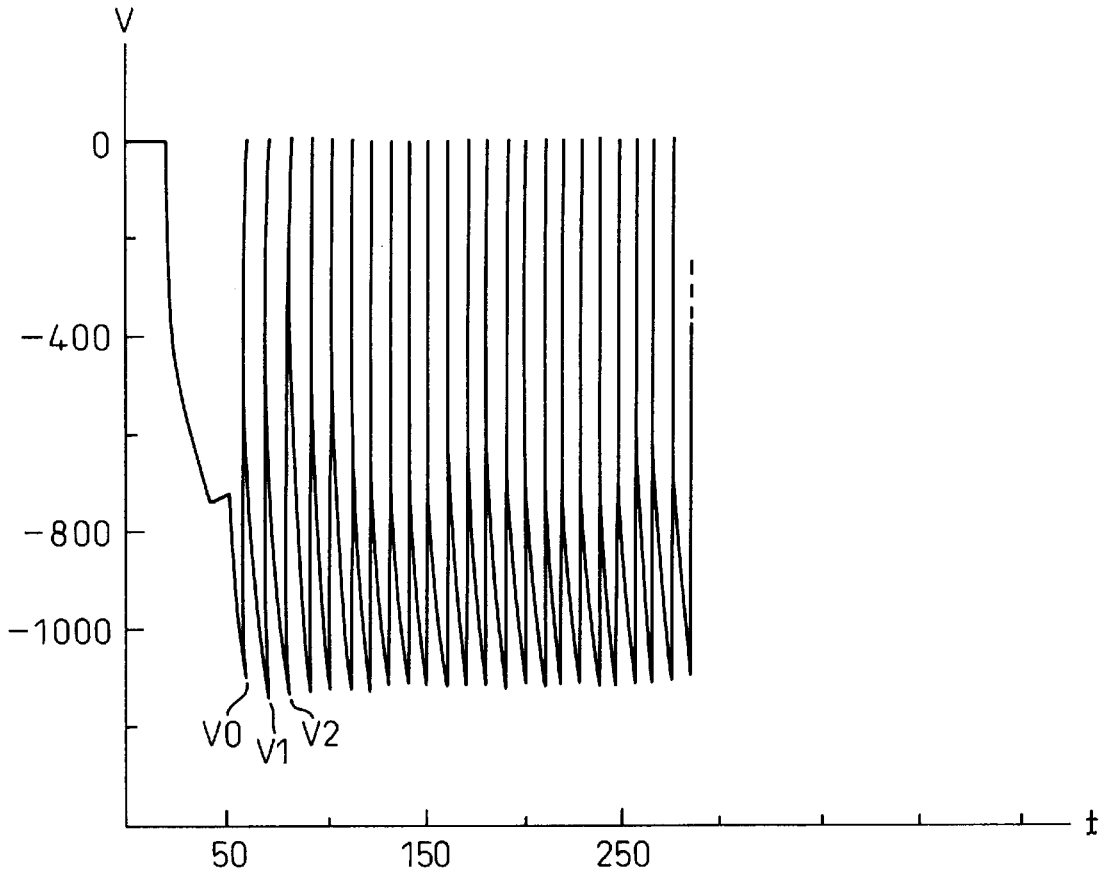
FIG. 10 is a view showing experimental data of the discharge tube of the present invention.

In FIG. 10 showing experimental data of the discharge tube, the vertical axis represents discharge voltage V generated between the upper discharge electrode 20*a* and the lower discharge electrode 20*b*, and one graduation of the vertical axis is set at −200 V. The horizontal axis represents time t, and one graduation of the horizontal axis is set at 50 msec. When the experimental data shown in FIG. 10 was obtained, the pulse width of voltage repeatedly impressed between the upper discharge electrode 20*a* and the lower discharge electrode 20*b* was set at 7.5 msec.

Figure 11:
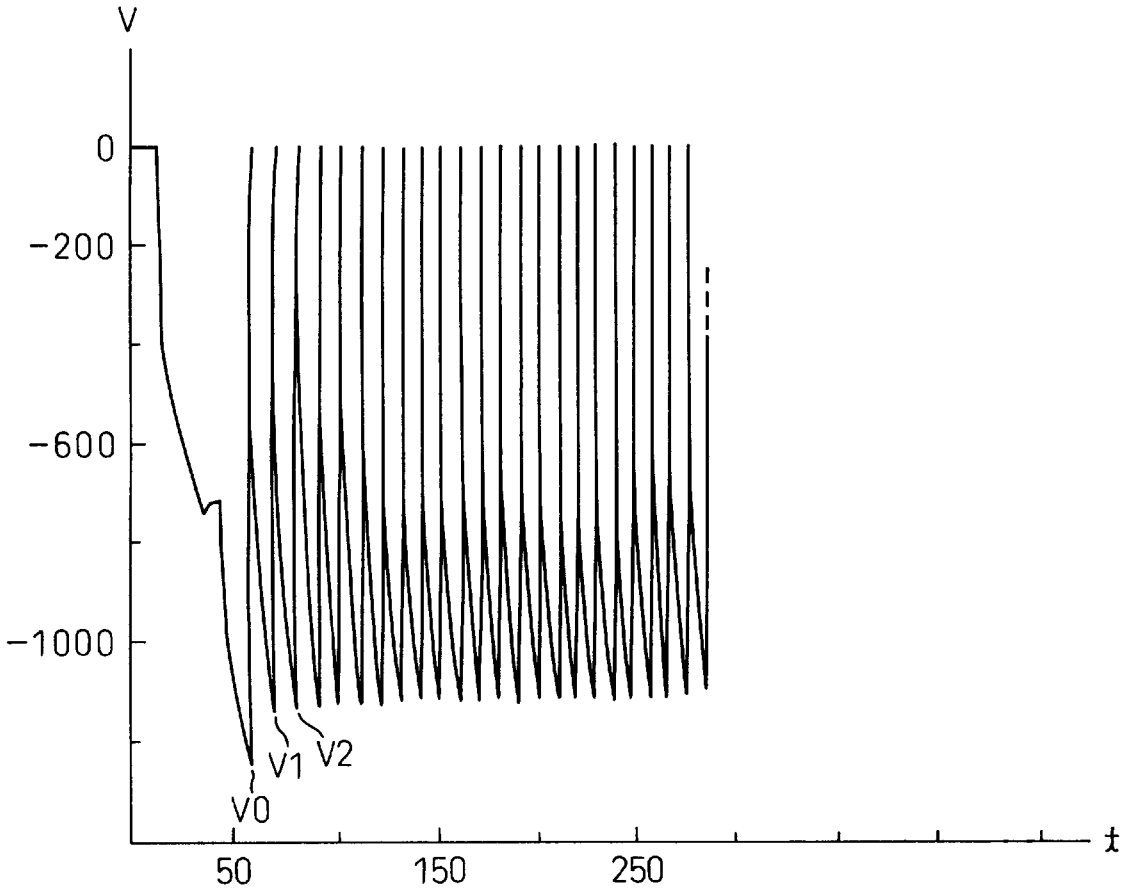
FIG. 11 is a view showing experimental data of the discharge tube.

In the discharge tube shown in FIG. 11, the following relational expression is satisfied, $$H < B/2 \text{ or } H < (A-B)/2$$

where A is a height of the airtight cylinder 10, B is a discharge gap between the fore end surfaces of the upper discharge electrode 20*a* and the lower discharge electrode 20*b*, and H is a distance between the upper end of the sub-discharge trigger wire 50 and the upper end edge of the airtight cylinder 10 opposed to the upper end of the sub-discharge trigger wire and H is also a distance between the lower end of the sub-discharge trigger wire 50 and the lower end edge of the airtight cylinder 10 opposed to the lower end of the sub-discharge trigger wire. In FIG. 11 showing experimental data of the discharge tube, the vertical axis represents discharge voltage V generated between the upper discharge electrode 20*a* and the lower discharge electrode 20*b*, and one graduation of the vertical axis is set at −200 V. The horizontal axis represents time t, and one graduation of the horizontal axis is set at 50 msec. When the experimental data shown in FIG. 11 was obtained, the pulse width of voltage repeatedly impressed between the upper discharge electrode 20*a* and the lower discharge electrode 20*b* was set at 7.5 msec.

As can be seen in FIG. 10, showing the experimental data of the discharge tube, if the sub-discharge trigger wires 50 are arranged on the inner circumferential wall of the air tight cylinder 10 so that the relational expression of $B/2 \leqq H \leqq (A-B)/2$ can be satisfied, the initial discharge starting voltage V0 generated between the fore end surfaces of the upper discharge electrode 20*a* and the lower discharge electrode 20*b* can be made to be substantially the same as the next time discharge starting voltages V1, V2, V3 . . . generated between the same fore end surfaces of the upper discharge electrode 20*a* and the lower discharge electrode 20*b*.

On the other hand, as can be seen in FIG. 11 showing the experimental data of the discharge tube, if the sub-discharge trigger wires 50 are arranged on the inner circumferential wall of the airtight cylinder 10 so that the relational expression of $B/2 \leqq H \leqq (A-B)/2$ is not satisfied, the initial discharge starting voltage V0 generated between the fore end surfaces of the upper discharge electrode 20*a* and the lower discharge electrode 20*b* is greatly raised higher at the next time discharge starting voltages V1, V2, V3 . . . generated between the same fore end surfaces of the upper discharge electrode 20*a* and the lower discharge electrode 20*b*.

Figure 12:
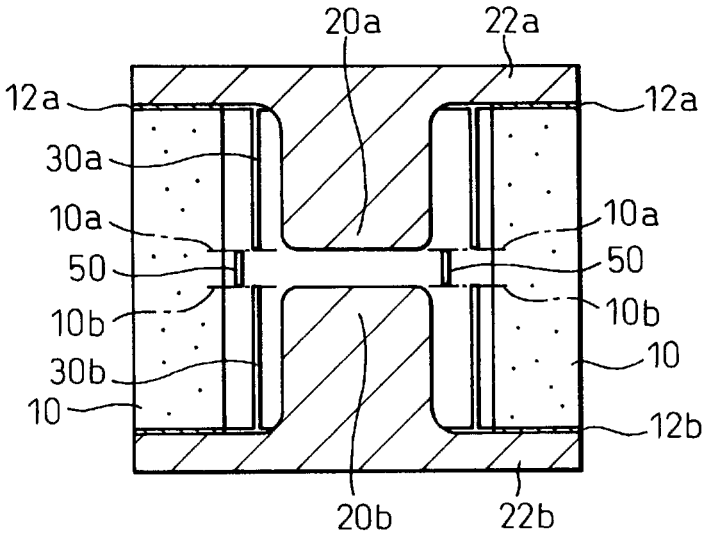
FIG. 12 is a front cross-sectional view of the discharge tube of the present invention.
Figure 13:
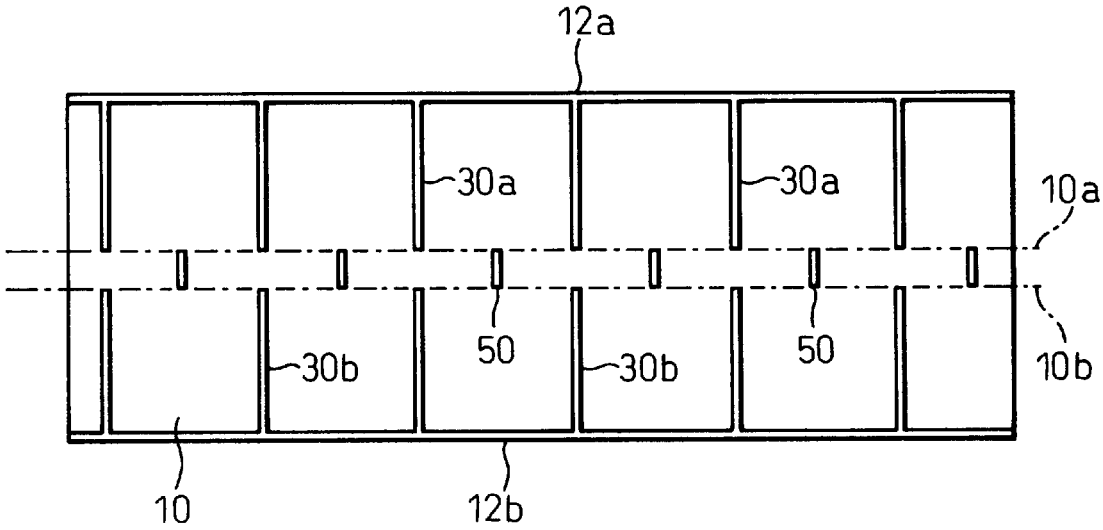
FIG. 13 is a development view of the inner circumferential wall of the airtight cylinder of the discharge tube of the present invention.

FIGS. 12 and 13 are views showing still another preferable embodiment of the discharge tube of the present invention. FIG. 12 is a front cross-sectional view of the discharge tube, and FIG. 13 is a development view of the inner circumferential wall of the airtight cylinder. This discharge tube will be explained as follows.

In the discharge tube shown in the drawings, the lower end portions of the discharge trigger wires 30*a* arranged in the upper portion of the inner circumferential wall of the airtight cylinder 10 are located at the same positions as those of the fore end faces of the upper discharge electrodes 20*a* or at the positions higher than those of the fore end faces of the upper discharge electrodes 20*a* when a view is laterally taken in a direction perpendicular to the axis of the airtight cylinder 10, and the upper end portions of the discharge trigger wires 30*b* arranged in the lower portion of the inner circumferential wall of the airtight cylinder 10 are located at the same positions as those of the fore end surfaces of the lower discharge electrodes 20*b* or alternatively at the positions lower than the fore end surfaces of the lower discharge electrodes 20*b* when a view is laterally taken in a direction perpendicular to the axis of the airtight cylinder.

Other points of the structure of the above discharge tube are the same as those of any discharge tube shown in FIGS. 1 to 7 or FIG. 9. Specifically, the structure of the discharge tube shown in FIGS. 12 and 13 is substantially the same as that of the discharge tube shown in FIG. 9. In this discharge tube, it is possible to arrange the discharge trigger wires 30*a*, 30*b* in the upper and the lower portion of the inner circumferential wall of the airtight cylinder 10 while not arranging them at the center of the inner circumferential wall of the airtight cylinder 10 to which the sputtering substance adheres in a belt-shape, wherein the sputtering substance is composed of metallic powder generated in the process of discharge from the fore end surfaces of the upper and the lower electrode on which coating for the formation of the discharge surface is coated, so that discharge can be stabilized at an early stage. In other words, the lower end of the upper discharge electrode 20*a* is located at the same position as that of the upper boundary 10*a* of the inner circumferential wall portion of the airtight cylinder 10 to which the sputtering substance 40 adheres in a belt-shape, or alternatively at the position higher than that of the upper boundary 10*a* of the inner circumferential wall portion of the airtight cylinder 10 to which the sputtering substance 40 adheres in a belt-shape when a view is taken in the lateral direction perpendicular to the axis of the airtight cylinder 10. At the same time, the upper end of the lower discharge electrode 20*b* is located at the same position as that of the lower boundary 10*b* of the inner circumferential wall portion of the airtight cylinder 10 to which the sputtering substance 40 adheres in a belt-shape, or alternatively at the position lower than that of the lower boundary 10*a* of the inner circumferential wall portion of the airtight cylinder 10 to which the sputtering substance 40 adheres in a belt-shape when a view is taken in the lateral direction perpendicular to the axis of the airtight cylinder 10. Accordingly, it is possible to precisely prevent the deterioration of electric insulation, which is caused by the sputtering substance 40, between the discharge trigger wires 30*a*, 30*b* arranged in the upper and the lower portion of the inner circumferential wall of the airtight cylinder 10.

In the discharge tube described above, two or more discharge trigger wires 30*a* and/or discharge trigger wires 30*b* may be arranged in the inner circumferential wall portion of the airtight cylinder 10 located between the sub-discharge trigger wires 50. Alternatively, two or more discharge trigger wires 30*a* and/or discharge trigger wires 30*b* may be arranged being opposed to each other. Even when the above arrangement is adopted, in the same manner as that of the discharge tube described before, it is possible to provide a discharge tube capable of discharging in quick response, in which there is no possibility of deterioration of the electrical insulating property between the discharge trigger wires 30*a*, 30*b*.

It is possible to adopt an arrangement in which the profiles and sizes of the discharge trigger wires 30*a*, 30*b* are different from each other and also the profiles and sizes of the sub-discharge trigger wires 50 are different from each other, that is, it is possible to adopt an arrangement in which the widths of end portions of the discharge trigger wires 30*a*, 30*b* and the sub-discharge trigger wires 50, at which the initial discharge is generated, are extended so that the end portions cannot be damaged at an early stage. Even when the above arrangement is adopted, it is possible to provide a discharge tube with a long life in the same manner as that of the discharge tube described before.

As explained above, according to the discharge tube of the present invention, it is possible to prevent the deterioration of the electrical insulating property, which is caused by the sputtering substance when discharge is conducted by the upper and the lower discharge electrode, between the discharge trigger wires by which the initial discharge is generated.

Also, it is possible to precisely generate an initial discharge in quick response between the end portions of the discharge trigger wires and the sub-discharge trigger wires located close to them. It is possible to positively and stably induce an electrical discharge in quick response between the fore end surfaces of the upper and the lower electrode located close to the discharge trigger wires and the sub-discharge trigger wires by which the initial discharge was generated.

As a result, it is possible to provide a discharge tube with long life in which no deterioration of electrical insulation is caused by the sputtering substance, and a discharge can be stably generated at an early stage in quick response between the fore end surfaces of the upper and the lower discharge electrode in the discharge tube.

It is to be understood that the invention is by no means limited to the specific embodiments illustrated and described herein, and that various modifications thereof may be made which come within the scope of the present invention as defined in the appended claims.

I claim:

1. A discharge tube in which an upper discharge electrode and lower discharge electrode are arranged in an airtight cylinder made of insulating material, being vertically opposed to each other in the axial direction of the airtight cylinder, an upper end opening and lower end opening of the airtight cylinder are airtightly closed by covers attached to the upper discharge electrode and the lower discharge electrode, and discharge trigger wires are arranged on an inner circumferential wall of the airtight cylinder, the discharge tube comprising:

sub-discharge trigger wires arranged at the center of the inner circumferential wall of the airtight cylinder, the sub-discharge trigger wires being electrically insulated from the upper discharge electrode and the lower discharge electrode;

discharge trigger wires electrically connected with the upper discharge electrode, the discharge trigger wires being arranged in an upper portion of the inner circumferential wall of the airtight cylinder; and discharge trigger wires electrically connected with the lower discharge electrode, the discharge trigger wires being arranged in a lower portion of the inner circumferential wall of the airtight cylinder, wherein distances from the respective discharge trigger wires to the sub-discharge trigger wires arranged close to the discharge trigger wires are made equal.

2. The discharge tube, according to claim 1, wherein the sub-trigger wires are arranged at the center of the inner circumferential wall of the airtight cylinder so that end portions of the sub-discharge trigger wires can overlap with fore end portions of the discharge trigger wires when a view is laterally taken in a direction perpendicular to the axis of the airtight cylinder.

3. The discharge tube, according to claim 1, wherein a plurality of sub-discharge trigger wires are arranged on the inner circumferential wall of the airtight cylinder at regular intervals, and the discharge trigger wires are regularly arranged in portions on the inner circumferential wall of the airtight cylinder between the respective sub-discharge trigger wires.

4. The discharge tube, according to claim 1, wherein the discharge trigger wires and/or the sub-discharge trigger wires are arranged in parallel with the axis of the airtight cylinder.

5. The discharge tube, according to claim 1, wherein the discharge trigger wires and/or the sub-discharge trigger wires are arranged oblique to the axis of the airtight cylinder.

6. The discharge tube, according to claim 1, wherein the profiles and sizes of the discharge trigger wires are the same, and the profiles and sizes of the sub-discharge trigger wires are the same.

7. The discharge tube, according to claim 1, wherein the discharge trigger wires electrically connected to the upper discharge electrode and the discharge trigger wires electrically connected to the lower discharge electrode are alternately arranged on the inner circumferential wall of the airtight cylinder.

8. The discharge tube, according to claim 1, wherein the discharge trigger wires electrically connected to the upper discharge electrode and the discharge trigger wires electrically connected to the lower discharge electrode are arranged on the inner circumferential wall of the airtight cylinder being opposed to each other.

9. The discharge tube, according to claim 1, wherein the following relational expression is satisfied, $$B/2 \leqq H \leqq (A-B)/2$$

where A is a height of the airtight cylinder, B is a discharge gap between the fore end surfaces of the upper and the lower discharge electrode, and H is a distance between an upper end of the sub-discharge trigger wire and an upper end edge of the airtight cylinder opposed to the upper end of the sub-discharge trigger wire and H is also a distance between a lower end of the sub-discharge trigger wire and a lower end edge of the airtight cylinder opposed to the lower end of the sub-discharge trigger wire.

10. The discharge tube, according to claim 1, wherein lower end portions of the discharge trigger wires arranged in the upper portion of the inner circumferential wall of the airtight cylinder are located at the same positions as the position of the fore end face of the upper discharge electrode or at the positions higher than the position of the fore end face of the upper discharge electrode when a view is laterally taken in a direction perpendicular to the axis of the airtight cylinder, and upper end portions of the discharge trigger wires arranged in the lower portion of the inner circumferential wall of the airtight cylinder are located at the same positions as the position of the fore end surface of the lower discharge electrode or alternatively at the positions lower than the position of the fore end surface of the lower discharge electrode when a view is laterally taken in a direction perpendicular to the axis of the airtight cylinder.

* * * * *